US005720230A

United States Patent [19]

Mansfield

[11] Patent Number: 5,720,230

[45] Date of Patent: Feb. 24, 1998

[54] SLIDING PULL-OUT SHELF

[76] Inventor: Shane Mansfield, 1917 Morrow, Dallas, Tex. 75217

[21] Appl. No.: 699,432

[22] Filed: Aug. 19, 1996

[51] Int. Cl.[6] ..... A47B 9/00

[52] U.S. Cl. ..... 108/108; 108/143; 211/DIG. 1

[58] Field of Search ..... 108/108, 143, 108/105, 102; 211/175, 90, DIG. 1; 248/240.1, 235, 206.5, 309.4

[56] References Cited

U.S. PATENT DOCUMENTS

| | | | |
|---|---|---|---|
| 2,357,668 | 9/1944 | Laham | 108/143 X |
| 4,602,570 | 7/1986 | Lee | 108/102 |
| 4,620,489 | 11/1986 | Albano | 108/143 X |
| 4,646,658 | 3/1987 | Lee | 108/143 |
| 4,736,689 | 4/1988 | Stanko | 108/143 X |
| 4,905,847 | 3/1990 | Hanson | 211/DIG. 1 X |
| 4,953,714 | 9/1990 | Paul | 211/DIG. 1 X |
| 5,078,281 | 1/1992 | Johnson | 211/DIG. 1 X |

*Primary Examiner*—Jose V. Chen

*Attorney, Agent, or Firm*—Goldstein & Associates

[57] ABSTRACT

A sliding pull-out shelf comprising a shelf board, a shelf bracket with at least one shelf bracket tang, a pair of vertical supports spaced a predetermined distance apart, a pair of telescopic slider mechanisms, a magnet, and a magnetic anchor. Each telescopic slider mechanism attaches each shelf board side to each shelf bracket. Each shelf bracket is secured to each vertical support with the shelf bracket tang which is inserted into the vertical support vertical slots. Each shelf bracket is secured to each vertical support such that the shelf brackets project horizontally and parallel to each other. The magnetic anchor lies in the same plane as the vertical supports and is located midway between the vertical supports. The magnet is attached to the shelf board and contacts the magnetic anchor when the shelf is fully against the vertical supports. The slider mechanism allows the shelf board to move horizontally away from the vertical supports if a force, greater than the magnetic force between the magnet and the magnetic anchor, is applied to the shelf board. With the shelf board moved horizontally away from the vertical supports, access to goods located towards the rear of the shelf board is facilitated.

3 Claims, 3 Drawing Sheets

SLIDING PULL-OUT SHELF

BACKGROUND OF THE INVENTION

The invention relates to a sliding pull-out shelf. More particularly, the invention relates to a shelf attached to a sliding mechanism which allows said shelf to be pulled away from a supporting shelf bracket.

Conventional shelves on the market generally consists of a thin shelf flat board, brackets with tangs, and vertical supports. The bracket tangs are inserted and locked into slots in the vertical supports. The thin shelf flat board generally rests on these brackets.

The conventional shelf can be found in practically all private and commercial settings where it is used to store and display goods. Shelves are ubiquitous, they are used in storerooms and closets, they adorn the isles of supermarkets, and line the walls of clothing stores around the world.

However, conventional shelves are not well suited for storing and displaying goods. The conventional shelf system consists of a number of shelves stacked one above the other. The shelf flat board of each individual shelf rests on a plurality of shelf brackets or is fixed thereto and cannot be pulled away from said shelf brackets. It is often difficult, and in some situations impossible, to reach items situated towards the rear of the shelf without completely unloading it because of the presence of another shelf directly overhead.

Another inherent problem with conventional shelf systems is that an upper shelf stacked above a lower shelf also obstructs the consumers line of sight to goods located towards the rear of the lower shelf. Furthermore, goods located in the rear portion of the lower shelf are obscured by a shadow created by the upper shelf.

The problem of both physical and visual overhead shelf interference also results in slower and less accurate inventory counts. Store employees are forced to tediously unload each and every shelf to make an accurate inventory count. Store owners unwilling to invest the time required for such an inventory count are forced to estimate. Such estimating leads to poor product rotation, poor allocation organization, and unnecessary back stock.

In anticipation of the difficulty of inventorying rear shelf contents, some store owners resort to loading only the visible easily accessible portion of their shelves. Thus the problem of overhead shelf interference inherent in the conventional fixed shelf system also results in wasted shelf space.

Another problem with the conventional fixed shelf is the difficulty of allocation organization. Attempts to keep items in their proper rows on the conventional fixed shelf are hampered if employees cannot reach the items.

While the conventional shelf may be suitable for the particular purpose employed, or for general use, it would not be as suitable for the purposes of the present invention as disclosed hereafter.

SUMMARY OF THE INVENTION

It is an object of the invention to provide a sliding pull-out shelf intended to overcome the deficiencies in the design of the conventional fixed shelf discussed heretofore, by providing easy access to goods situated towards the rear of said shelf. The object is accomplished by the incorporation of a sliding element which is attached between a shelf bracket and a shelf flat board. The sliding element allows the shelf flat board to be pulled away from the shelf bracket and out from under an overhead shelf. With the shelf pulled out, the rear of said shelf is exposed and any item located there is easily reachable.

It is another object of the invention to produce a shelf which maximizes available merchandising space. The rear portion of a shelf is generally not loaded by store owners because goods there located cannot be seen by consumers. The invention transforms this wasted rear shelf space into merchandising space by providing a clear line of sight to the rear portion of said shelf. The sliding element allows the shelf flat board to be pulled away from the shelf bracket and out from under the obstructing overhead shelf. With the shelf flat board pulled out, all of the goods on the shelf, are displayed including the goods located toward the rear of said shelf.

It is a further object of the invention to produce a shelf which allows for precise inventory counts. With the shelf flat board pulled out from under an overhead shelf, all of the goods on the shelf, including the goods located toward the rear of said shelf can be accurately accounted for.

It is a still further object of the invention to produce a shelf which facilitates allocation organization. Pulling the shelf out from under an overhead shelf drastically reduces the amount of effort necessary to maintain items in their proper rows.

The invention is a sliding pull-out shelf comprising a shelf board, a shelf bracket with at least one shelf bracket tang, a pair of vertical supports spaced a predetermined distance apart, a pair of telescopic slider mechanisms, a magnet, and a magnetic anchor. Each telescopic slider mechanism attaches each shelf board side to each shelf bracket. Each shelf bracket is secured to each vertical support by means of the shelf bracket tang which is inserted into the vertical support vertical slots. Each shelf bracket is secured to each vertical support such that the shelf brackets project horizontally and parallel to each other. The magnetic anchor lies in the same plane as the vertical supports and is located midway between the vertical supports. The magnet is attached to the shelf board and contacts the magnetic anchor when the shelf is fully against the vertical supports. The slider mechanism allows the shelf board to move horizontally away from the vertical supports if a force, greater than the magnetic force between the magnet and the magnetic anchor, is applied to the shelf board. With the shelf board moved horizontally away from the vertical supports, access to goods located towards the rear of said shelf board is facilitated.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
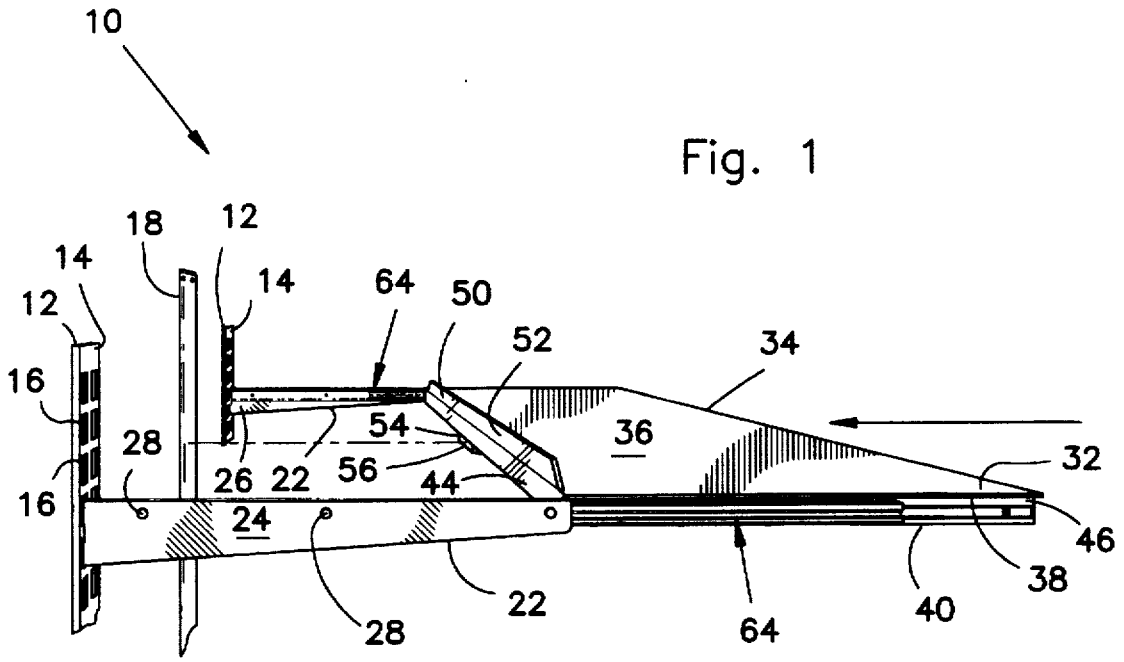
FIG. 1 is a perspective view of the sliding pull-out shelf, illustrated in an expanded position wherein the shelf flat board is pulled away from the vertical supports.

FIG. 1 illustrates a sliding pull-out shelf 10 comprising a pair of parallel vertical supports 12, a magnetic anchor 18, a pair of shelf brackets 22, a pair of telescopic sliders 64, and a shelf flat board 32. The vertical supports 12, have a vertical support front surface 14 having a plurality of evenly spaced vertical support vertical slots 16. The vertical supports are parallel to each other and are spaced a predetermined distance apart. The predetermined distance is substantially the same as the width of the shelf flat board 32. The magnetic anchor 18 lies in the same plane as the vertical supports 12, is parallel to the vertical supports 12, and is located midway between the vertical supports 12. Each shelf bracket 22 has a shelf bracket inner surface 26, a shelf bracket outer surface 24, and three evenly spaced shelf bracket screw holes 28 extending from the shelf bracket inner surface 26 to the shelf bracket outer surface 24. The shelf brackets 22 are secured to the vertical supports 12, and projects from the vertical support front surface 14 such that the shelf brackets 22 extend horizontally and parallel to each other. The shelf flat board 32 has a shelf flat board top 34, a shelf flat board bottom surface 40, a pair of shelf flat board side surfaces 46, a shelf flat board back surface 44, a shelf flat board ledge 50 having a shelf flat board ledge back surface 52. The shelf flat board 32 is located between the shelf brackets 22. The shelf flat board top 34 has a shelf flat board top upper surface 36 and a shelf flat board top lower surface 38. The shelf flat board ledge 50 projects from the shelf flat board top upper surface 36. The shelf flat board ledge back surface 52 is flush with the shelf flat board back surface 44. Each telescopic slider 64 is secured to one of the shelf bracket inner surfaces 26 and to one of the shelf flat board side surfaces 46. The telescopic sliders 64 allows the shelf flat board 32 to move horizontally away and toward the pair of vertical supports 12. A magnet 54, having a magnet back surface 56, is secured to the shelf flat board bottom surface 40 midway between the shelf flat board side surfaces 46. The magnet back surface 56 is flush with the shelf flat board back surface 44 and the shelf flat board ledge back surface 52.

Figure 2:
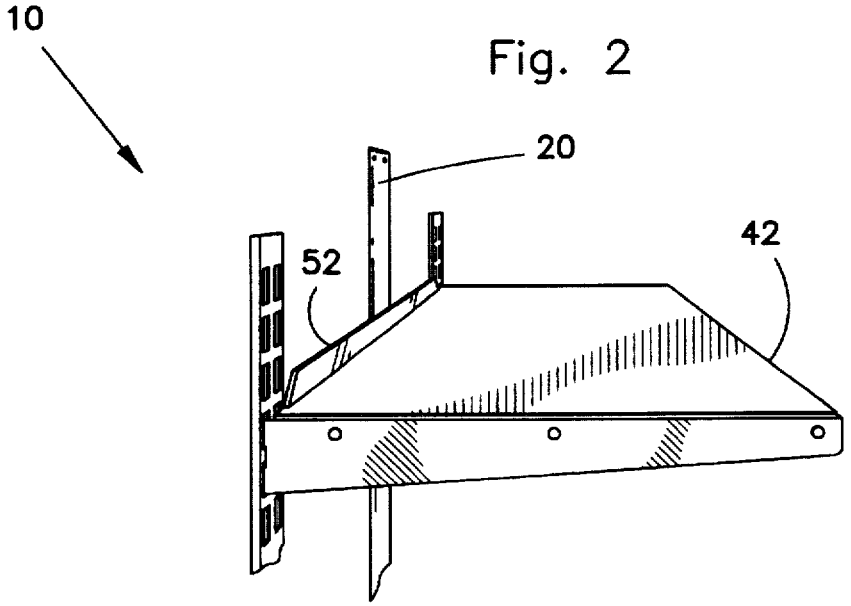
FIG. 2 is a perspective view of the sliding pull-out shelf in a compressed position wherein the shelf flat board is fully against the vertical supports.

FIG. 2 illustrates the sliding pull-out shelf 10 with the shelf flat board ledge back surface 52 in contact with the magnetic anchor front surface 20. The magnet back surface 56 is also in contact with the magnet anchor front surface 20. A magnetic force between the magnetic anchor 18 and the magnet 54 opposes horizontal motion of the shelf flat board 32 directed away from the vertical supports 12. A force applied to the shelf bard front surface 42, which is less than a threshold force equivalent to the magnetic force between the magnet 54 and the vertical magnetic anchor 18, will fail to move the shelf flat board 32 away from the vertical supports 12.

Figure 3:
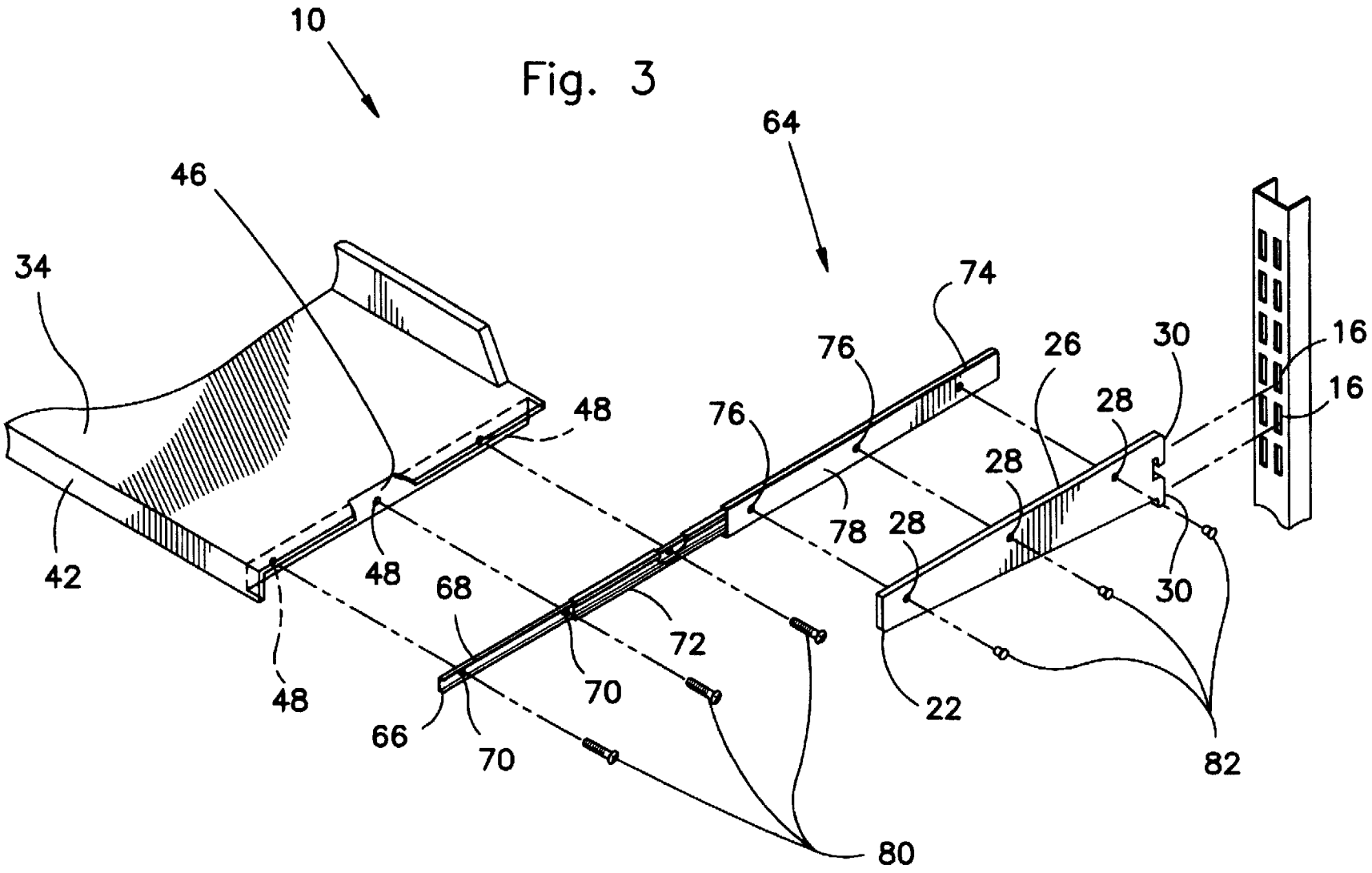
FIG. 3 is an exploded view illustrating the manner in which the various components of the sliding pull-out shelf are assembled.

FIG. 3 illustrates the various components of the sliding pull-out shelf 10 in an unassembled state. The shelf flat board top 34 extends beyond and overhangs over each shelf flat board side surface 46. The shelf flat board front surface 42 extends beyond each shelf flat board side surface 46. Each shelf flat board side surface 46 has three evenly spaced shelf flat board side surface screw holes 48. Each shelf bracket 22 has a pair of shelf bracket tangs 30. As illustrated in FIG. 1 and FIG. 2 the shelf bracket tangs 30 are inserted and locked into the vertical support vertical slots 16. The telescopic slider 64 has a first telescopic slider element 66, a second telescopic slider element 72 which envelopes the first telescopic slider element 66, and a third telescopic slider element 74. The third telescopic slider element 74 envelopes the first telescopic slider element 66 and the second telescopic slider element 72. The first telescopic slider element 66 has a first telescopic slider element inner surface 68, and three evenly spaced first telescopic slider element screw holes 70. The third telescopic slider element 74 has a third telescopic slider element outer surface 78, and three evenly spaced third telescopic slider element screw holes 76. First type screws 80 screw into the first telescopic slider element screw holes 70 and into the shelf flat board side surface screw holes 48. Said first type screws 80 attach each first telescopic slider element 66 to each shelf flat board side surface 46 such that the shelf flat board side surface 46 is in contact with first telescopic slider element inner surface 68. Second type screws 82 screw into the shelf bracket screw holes 28 and into the third telescopic slider element screw holes 76. Said second type screws 82 attach each shelf bracket 22 to each third telescopic slider element 74 such that the third telescopic slider element outer surface 78 is in contact with the shelf bracket inner surface 26.

Figure 4:
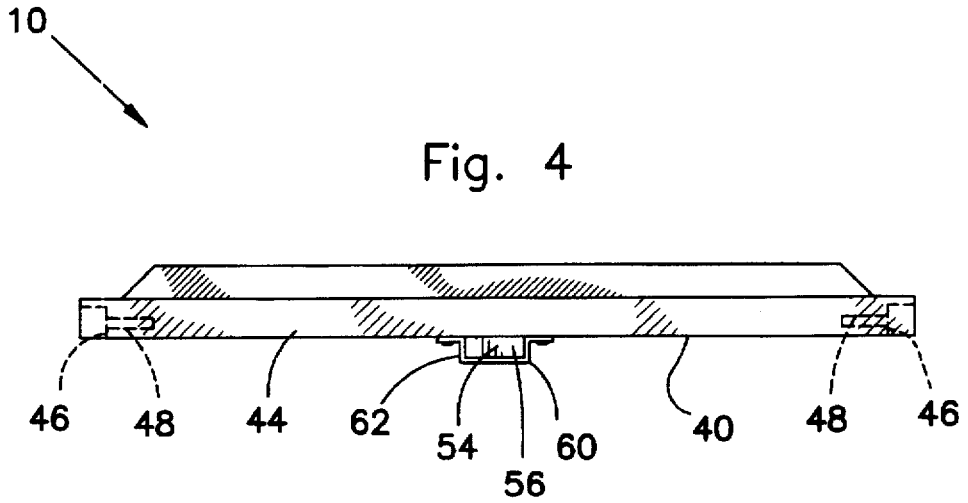
FIG. 4 is a rear perspective view of the sliding pull-out shelf.

FIG. 4 illustrates the rear of the shelf flat board 32. A magnet bracket 60, having a magnet bracket back surface 62, is secured to the shelf flat board bottom surface 40 midway between the shelf flat board side surfaces 46. Said magnet bracket 60 secures the magnet 54 to the shelf flat board bottom surface 40 such that the magnet 54 is in contact with the shelf flat board bottom surface 40 and both the magnet back surface 56 and the magnet bracket back surface 62 are flush with the shelf flat board back surface 44. Two of the shelf flat board side surface screw holes 48 can be seen.

Figure 5:
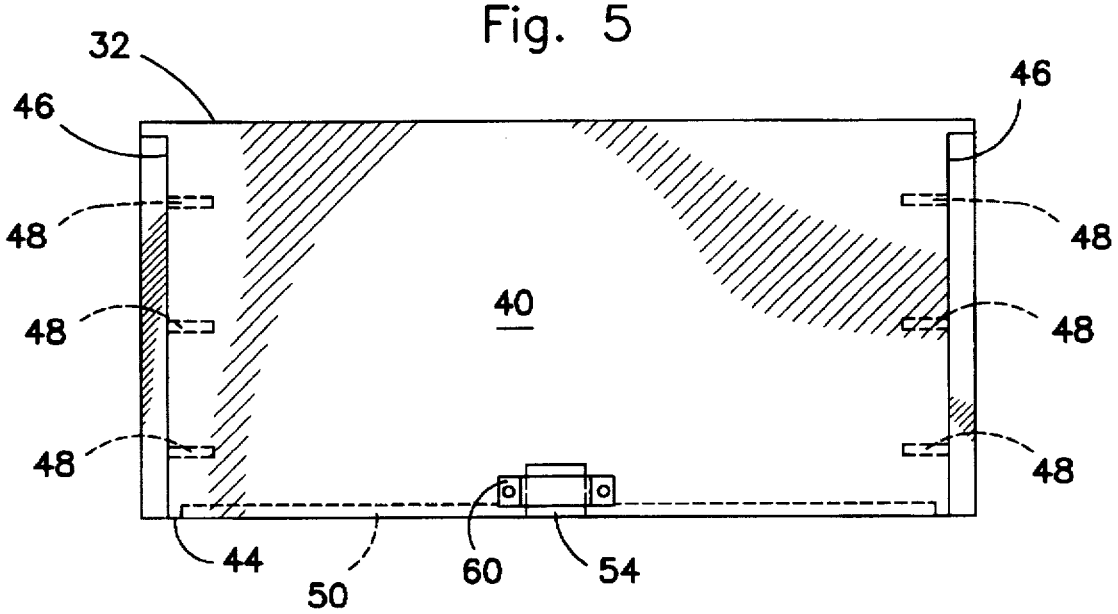
FIG. 5 is a bottom plan view of the shelf flat board.

FIG. 5 illustrates the bottom of the shelf flat board 32. All six of the shelf flat board side surface screw holes 48 can be seen evenly spaced along each shelf flat board side surface 46. The magnet 54 and the magnet bracket 60 can be seen secured to the shelf flat board bottom surface 40. The shelf flat board ledge 50 can also be seen.

What is claimed is:

1. A sliding pull-out shelf comprising:

a) a pair of vertical supports spaced a predetermined distance apart each having a plurality of vertical support vertical slots;

b) a pair of shelf brackets spaced a predetermined distance apart having one or more shelf bracket tangs and a shelf bracket inner surface, each shelf bracket projects from one of the vertical supports and is secured to said vertical support by inserting the shelf bracket tangs into the vertical support vertical slots such that the shelf brackets extend horizontally and parallel to each other;

c) a shelf board having a shelf board bottom surface, a shelf board back surface, a shelf board top, a pair of shelf board side surfaces, and a shelf board ledge, the shelf board top has a shelf board top upper surface and a shelf board top lower surface, the shelf board side surface is attached to the shelf board top lower surface, the shelf board top extends beyond and overhangs over each shelf board side surface, the shelf board back surface extends beyond the shelf board side surface, the shelf board ledge has a shelf board ledge back surface, the shelf board ledge projects from the shelf board top upper surface, the shelf board ledge back surface is flush with the shelf board back surface, the shelf board is located between the shelf brackets;

d) a pair of telescopic sliders each having a first telescopic slider element, a second telescopic slider element which envelopes the first telescopic slider element, and a third telescopic slider element which envelopes both the first telescopic slider element and the second telescopic slider element, the first telescopic slider element has a first telescopic slider element inner surface, the third telescopic slider element has a third telescopic slider element outer surface, each first telescopic slider element inner surface is attached to one of the shelf board side surfaces, each third telescopic slider element outer surface is attached to one of the shelf bracket inner surfaces, the telescopic slider attaches between each shelf board side surface and each shelf bracket inner surface allowing the shelf board to move horizontally toward and away from the vertical supports by a force applied to the shelf board front surface.

2. The sliding pull-out shelf as in claim 1 further comprising a locking means having a magnetic anchor, and a magnet having a magnet top surface and a magnet back surface, the magnet top surface is secured to the shelf board bottom surface midway between the shelf board side surfaces, the magnet back surface is flush with the shelf board back surface, the magnetic anchor lies in the same plane as the vertical supports and is located midway between the vertical supports such that the magnet back surface contacts the magnetic anchor when the shelf board back surface is in contact with the vertical supports, a magnetic force between the magnet and the magnetic anchor prevents a second weaker force applied to the shelf board front surface from moving the shelf board horizontally away from the vertical supports.

3. A sliding pull-out shelf comprising:

a) a pair of vertical supports spaced a predetermined distance apart;

b) a pair of shelf brackets spaced a predetermined distance apart each having a shelf bracket inner surface, each shelf bracket is secured to one of the vertical supports and projects from said vertical support such that the shelf brackets extend horizontally and parallel to each other;

c) a shelf board having a shelf board top surface, a shelf board bottom surface, a shelf board back surface, and a pair of shelf board side surfaces, the shelf board is located between the shelf brackets;

d) a pair of telescopic sliders, each having a plurality of telescopic slider elements including a first telescopic slider element, and a final telescopic slider element that envelopes all of the telescopic slider elements, the first telescopic slider element is enveloped by all of the telescopic slider elements, one of the final telescopic slider elements is attached to each shelf bracket inner surface, one of the first telescopic slider elements is attached to each shelf board side surface, one telescopic slider attaches between each shelf bracket inner surface and each shelf board side surface allowing the shelf board to move horizontally toward and away from the vertical supports; and e) a locking means, comprising a magnetic anchor and a magnet secured to the shelf board having a magnet top surface secured to the shelf board bottom surface midway between the shelf board side surfaces and a magnet back surface flush with the shelf board back surface, the magnetic anchor contacting the magnet when the shelf board back surface is in contact with the vertical supports, the magnetic anchor lies in the same plane as the vertical supports and is located midway between the vertical supports thereby creating a magnetic force between the magnet and the magnetic anchor that opposes horizontal motion of the shelf directed away from the vertical supports, for preventing a force below a threshold magnitude applied to the shelf board front surface from moving the shelf board horizontally away from the vertical supports.

* * * * *